US005393264A

United States Patent [19]

Kraft et al.

[11] Patent Number: 5,393,264

[45] Date of Patent: Feb. 28, 1995

[54] CONTINUOUS BUSINESS FORM HAVING DISCRETE POCKETS

[75] Inventors: Roger E. Kraft; Merlin F. Mercer; Roy A. Johnson, all of Fort Scott, Kans.

[73] Assignee: Ward/Kraft, Inc., Fort Scott, Kans.

[21] Appl. No.: 82,987

[22] Filed: Jun. 25, 1993

[51] Int. Cl.[6] ..... B41L 1/26

[52] U.S. Cl. ..... 462/6; 462/11; 462/31; 462/900; 281/5

[58] Field of Search ..... 281/5, 8–12; 462/6, 11, 26, 31, 64, 900; 229/69

[56] References Cited

U.S. PATENT DOCUMENTS

| | | | |
|---|---|---|---|
| 1,799,865 | 4/1931 | Rife . | |
| 2,220,071 | 11/1940 | Avery . | |
| 2,303,346 | 12/1942 | Flood . | |
| 3,501,365 | 3/1970 | Marshall . | |
| 4,060,168 | 11/1977 | Romagnoli . | |
| 4,150,183 | 4/1979 | Reed . | |
| 4,159,585 | 7/1979 | Brown . | |
| 4,214,024 | 7/1980 | Jacobson . | |
| 4,231,833 | 11/1980 | Lieberman . | |
| 4,379,573 | 4/1983 | Lomeli, et al. . | |
| 4,425,386 | 1/1984 | Chang . | |
| 4,586,611 | 5/1986 | Scalzo . | |
| 4,729,506 | 3/1988 | Neubauer . | |
| 4,868,027 | 9/1989 | Hunkeler, et al. . | |
| 4,877,177 | 10/1989 | Felix . | |
| 4,978,142 | 12/1990 | Kaluza | 462/6 |
| 5,011,559 | 4/1991 | Felix . | |
| 5,021,110 | 6/1991 | Kobayashi . | |
| 5,021,273 | 6/1991 | Kobayashi . | |
| 5,052,977 | 10/1991 | Irvine | 462/6 |
| 5,061,170 | 10/1991 | Allen et al. . | |
| 5,183,203 | 2/1993 | Sanders | 462/6 X |

FOREIGN PATENT DOCUMENTS

| | | | |
|---|---|---|---|
| 129948 | 1/1985 | European Pat. Off. | 462/6 |
| 1432758 | 4/1976 | United Kingdom | 462/6 |
| 2127378 | 4/1984 | United Kingdom . | |

OTHER PUBLICATIONS

Flexo Accessories Co. Propheteer 700 Standard Features Photo and Data Sheet

Webtron 1000 Drawing and Description

Allied Gear Flexomaster I Description and Drawing

Allied Gear Flexomaster II Drawing and General Description

Comco Equipment, Inc. Commander Drawing and Specifications

Comco Equipment, Inc. Print Station Drawing

Magna-Graphics MCC Flexo Press Photos and Description

Mark Andy, Inc. Mark Andy 2200 Drawing, Specifications and Description

Ko-Pack 250 Drawing and Description

*Primary Examiner*—Peter Dungba Vo

*Attorney, Agent, or Firm*—Hovey, Williams, Timmons & Collins

[57] ABSTRACT

A business form having a base sheet and a web adhered thereto forming a discrete pocket is provided. The web is applied and adhered to the base sheet whereby the surrounding margin of the web is recessed from the circumscribing edge of the base sheet. The continuous form can be fan-folded without binding or interference as the fold lines of the base sheet are free from interference by the web, The base sheet may be coated with carbonless transfer media as may be an insert ply positioned between the web and the base sheet to permit inscriptions on the base sheet to be transferred to a ply which may be subsequently removed.

11 Claims, 2 Drawing Sheets

CONTINUOUS BUSINESS FORM HAVING DISCRETE POCKETS

BACKGROUND OF THE INVENTION

1. Field of the Invention

This invention concerns a business form having discrete pockets formed thereon from separate pocket-forming elements. More particularly, the business form of the present invention includes a base sheet and an adhesively-attached pocket-forming element which has a surrounding margin which is recessed from the edge of the base sheet.

2. Description of the Prior Art

A number of different types of business forms are known, including those wherein plastic film is adhered to a base sheet or envelope to form an exterior pocket. These articles have proven very useful in that thin articles and sheets of paper can be placed in these pockets and viewed and/or stored until they need to be retrieved.

One disadvantage with the present forms is the difficulty in providing a form which includes a film layer which can be attached to form a pocket, yet remain easy to produce and capable of fan-folding without bulges or binding. It would be most advantageous if a business form could be developed which could be continuously and economically produced whereby multiple forms could be fan-folded or otherwise collected en masse without disrupting the collected group.

SUMMARY OF THE INVENTION

This problem has largely been solved by the business form of the present invention, which provides a business form which can be continuously produced with a discrete pocket formed by a film layer which is separate and discrete from the film on adjacent sheets.

In the invention hereof, a web of film or the like is provided which is smaller in area and joined by adhesive to a base sheet. A number of such base sheets are typically continuously produced, separated by perforations or the like so that individual form sheets can be separated. The surrounding margin of the web is recessed from the edge of the base sheet so that the web forms a pocket discrete from the webs on adjacent sheets. In this regard, the web used to form the pocket may be large or small, and located centrally or approximate the edge of the base sheet, provided the margin thereof is recessed relative to the edge of the base sheet. Thus, when the form is completed and, e.g., fan-folded, the web does not bind the separation between sheets and the sheets lay flat.

In especially preferred forms of the present invention, a carbonless transfer media may be applied to the web, whereby writing may be applied to the film and transferred to a complementally coated insert placed in the pocket formed by the web and the base sheet. Multiple sheets may be provided in the form, such as additional sheets provided in superposed relationship to a base sheet or cover sheet to present a multipart form, and may be joined along separable tabs along the edges by adhesive, crimping or other means. If desired, an insert ply may be placed between the web in the base sheet, whereupon the web may have a carbonless back coating and the insert a carbonless front coating to receive images formed by the impact of a stylus on the web. Such an insert may be attached to a tab along the edge of the base sheet until separation is desired.

DESCRIPTION OF THE PREFERRED EMBODIMENT

Figures 1, 2, 3, 4, 5, 6:
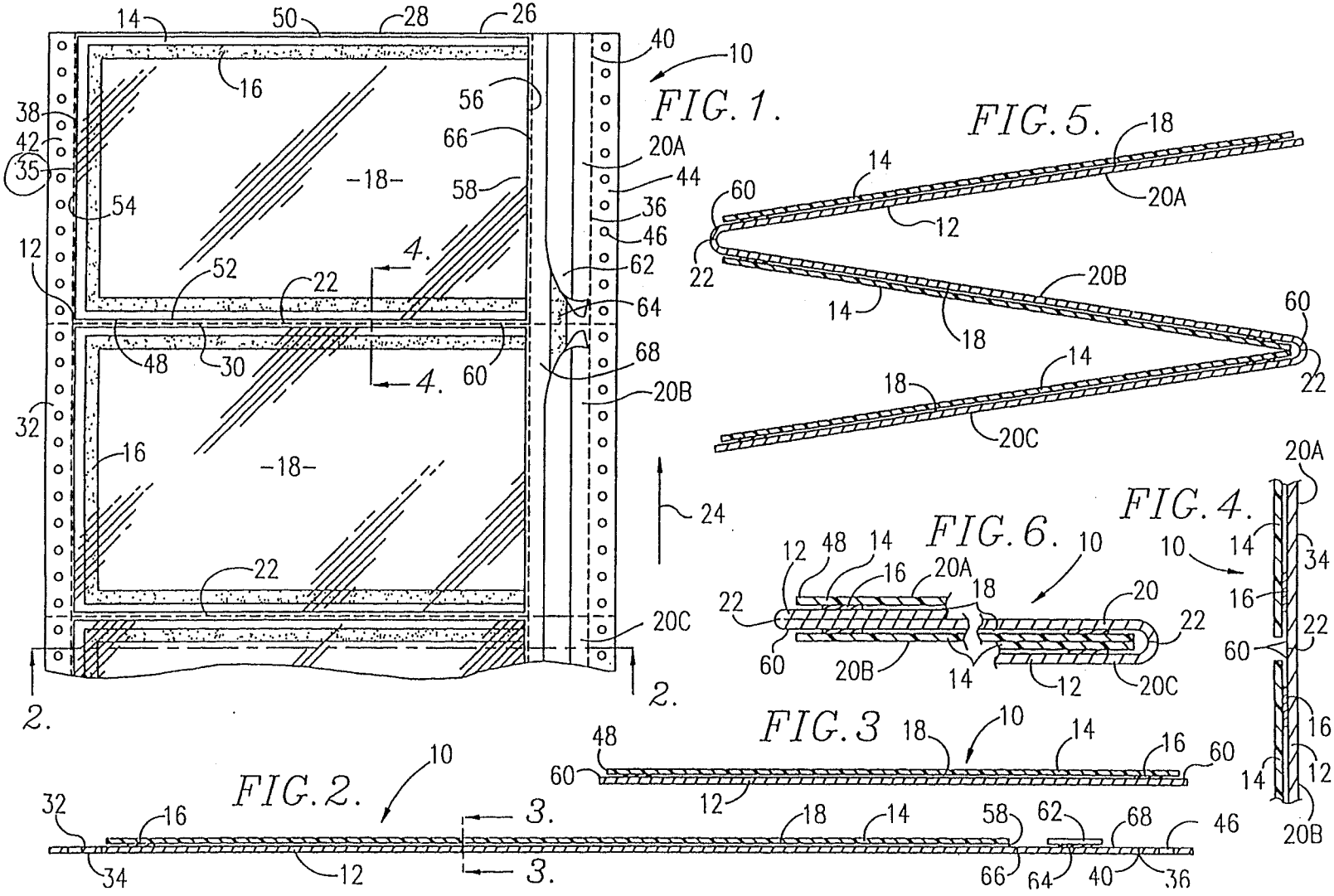
FIG. 1 is a plan view of a continuous business form in accordance with the present invention showing a transparent film web positioned on each of the adjacent form elements to form a discrete pocket.
FIG. 2 is an enlarged cross-sectional view taken along line 2—2 of FIG. 1.
FIG. 3 is an enlarged cross-sectional view taken along line 3—3 of FIG. 2.
FIG. 4 is an enlarged fragmentary cross-sectional view taken along line 4—4 of FIG. 1.
FIG. 5 is a cross-sectional view of a continuous business form in accordance with the present invention showing the relative positioning of the base sheets and the webs during fan-folding.
FIG.6 is an enlarged cross-sectional view similar to FIG. 5 with portions removed to show the continuous form hereof fan-folded to a flat position.

Referring now to the drawings, a continuous business form 10 in accordance with the present invention includes a base sheet 12, a web 14 preferably of synthetic resin film superimposed thereon and a quantity of adhesive 16 positioned therebetween to form a pocket 18 between the base sheet 12 and the web 14. The form 10 includes individual and sheet members 20 which are separable from one another along lines of weakness 22 which are oriented transversely to the direction of feed of the form 10 during manufacture, as indicated by the arrow 24 in FIG. 1. Each sheet member 20 includes a circumscribing edge 26, defined in part by the lines of weakness 22 extending along the top edge 28 of one sheet member and the bottom edge 30 of the base sheet 12 of the next successive sheet member 20.

In greater detail, the base sheet 12 is made of, e.g., paper, and includes a first side 32 and a second side 34. In addition to the top edge 28 and the bottom edge 30, the base sheet 12 also includes side edges 34 and 36 defined by longitudinal perforation lines 38 and 40, respectively. Tractor feed tabs 42 and 44 having holes 46 are separable along the perforation lines 38 and 40 as desired for use.

Web 12 is smaller in area than the base sheet 14. The web 14 includes a surrounding margin 48 which is thus located entirely within the circumscribing edge 26 of the base sheet 12 against which the web 14 lies. The margin 48 of the web 14 includes a top margin 50, a bottom margin 52, and side margins 54 and 56. In the embodiments shown herein, adhesive 16 is applied between the base sheet 12 and the web 14 along top margin 50, bottom margin 52 and one side margin 54, with side margin 56 being free of adhesive to define a gap 58 between the base sheet 12 and the web 14 therealong. This gap 58 thereby provides an opening to permit the user to insert objects into the pocket 18. The adhesive 16 is preferably applied by a slot die or screen printer, and may be of any type known to those skilled in the art, including hot-melt thermoplastic adhesives. As the form 10 is manufactured, the webs 14 are discretely positioned on the base sheet 12 of each sheet member 20, whereby a web-free zone 60 is defined on the base sheet of each member 20 around the surrounding margin 48.

Advantageously, a strip of adhesive-backed tape 62 or paper to which adhesive has been applied may be positioned parallel to side margin 56, although other positions are feasible. The tape 62 is placed over a ribbon 64 of silicone release coating so as to be readily removable from the base sheet 12. A line 66 may be scored by die cutting or perforated to extend longitudinally and parallel to the side margin 56. A flap 68 is thus defined between the line 66 and the longitudinal perforation line 40.

Figure 7:
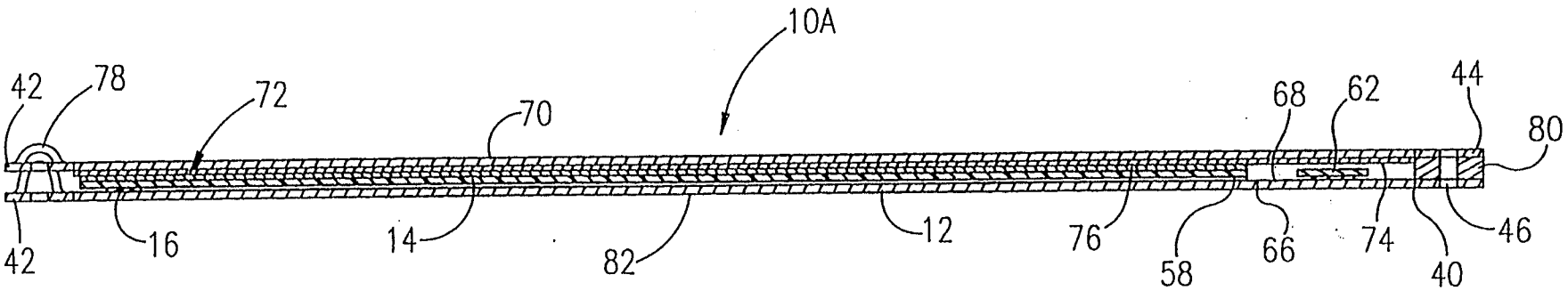
FIG. 7 is a cross-sectional view in a direction similar to FIG. 2 of an alternate embodiment of the present invention showing the placement of the web between the base sheet and a cover sheet and use of layers of carbonless transfer media for recording imprints from a stylus applied to the cover sheet.

FIG. 7 illustrates an alternate embodiment 10A of the form hereof. Form 10A is substantially similar to form 10, but includes both a cover sheet 70 and carbonless transfer media 72 including carbonless back coating 74 and carbonless front coating 76. The carbonless back coating 74 is applied to the inside face of cover sheet 70 and the carbonless front coating 76 is applied to the opposing face of web 14. These coatings are known to those skilled in the art, and in this regard reference may be made to, for example, U.S. Pat. Nos. 4,425,386; 4,275,905; 3,367,452 and 3,632,378, the disclosures of which are incorporated by reference. The cover sheet 70 may be joined to the base sheet 12 along the removable tractor feed tabs 42 and 44 by either crimp folds 78 or adhesive 80, as illustrated.

During manufacture, the forms 10 or 10A are fed in the direction of the arrow 24. As the base sheet 12 is fed, adhesive 16 is applied preferably by a slot die in a desired pattern as shown to secure the web 14 to the base sheet 12. The web 14, which is desirably polypropylene film which is either transparent or opaque, is adhered to the base sheet in a position which provides web-free zone 60 on the base sheet 12. The web 14 is cut and individually fed for placement on the base sheet 12 to which the adhesive 16 has been applied. Thereafter, the base sheet is die cut and perforated as desired. The strip of tape 62 may be applied to the base sheet 12 either before or after application of the web 14, but prior to the step of cutting the transverse line of weakness 22 so that the tape 62 is also severed. In the case of form 10A, the carbonless back and carbonless front coatings are applied to the respective cover sheet 70 and web 14 prior to mating the cover sheet 70 to the base sheet 12 by crimping or application of adhesive.

The forms 10 and 10A may then be fan-folded along lines of weakness 22 as shown in FIGS. 5 and 6. In this regard, the provision of the web-free zones 60 allow the sheet members 20A, 20B and 20C to be folded along the transverse lines of weakness 22 without binding so that when fully folded, as shown in FIG. 6, the sheet members 20 lie parallel and flat without substantial bulging along the top and bottom edges of each base sheet 12.

While the forms 10 and 10A have a variety of uses, one such use is as an inexpensive container for receiving plys of paper or small objects into the pocket 18 and recording information regarding the contents on the second side 82 of the base sheet. With respect to form 10A, a stylus such as a typewriter or pen may be used to impact the cover sheet and cause the image imprinted thereon to be simultaneously transferred to the web 14. When the cover sheet 70 is removed, the web 14 retains the image thereon. The removable tractor feed tabs 42 and 44 serve to make the form useful with a computer printer or the like when multiple forms are to be used sequentially, as is common. In this instance, each sheet member 20 may be separated along the line of weakness 22 after printing on the second side 32 by the printer or the like. In the case of form 10A, the printing may be applied to the cover sheet 72 to cause the image to be transferred to the web 14.

When paper or an object is placed in the pocket 18, the tape 62 may be removed from the base sheet 12. The flap 68 may then be folded over on top of the web 14 and attached thereto by the tape 62. This encloses the object within the pocket 18 formed between the base sheet 12 and the web 14, and when a sufficiently strong adhesive is employed to cause tearing of the web and/or cover sheet when removed, will also evidence whether there has been any tampering with the contents.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state his intent to rely on the Doctrine of Equivalents to determine and assess the reasonably fair scope of their invention as pertains to any apparatus not materially departing from but outside the liberal scope of the invention as set out in the following claims.

We claim:

1. A continuously produced business form comprising:

at least first, second and third consecutive and interconnected base sheets, at least said second base sheet being separable from said first and third base sheets along a transversely extending line of weakness, each of said base sheets having a first side, a second side, and a circumscribing edge defining therewithin a web-receiving area substantially free of lines of weakening;

a plurality of discrete webs constructed from synthetic resin film and each presenting a surrounding margin; and a quantity of adhesive applied to said first side of each of said base sheets for securing a respective one of said discrete webs thereto in substantially coplanar relationship to a corresponding one of said base sheets, with the entire surrounding margin of each web positioned inwardly and in recessed relationship relative to the circumscribing edge of the web-receiving area of the corresponding base sheet to which said web is adhered to present a web-free zone on each corresponding base sheet between each respective surrounding margin and corresponding circumscribing edge to thereby locate the entire surrounding margin of the web adhered to the corresponding base sheet in discrete spaced relationship relative to a web adhered to a sequential, adjacent one of said sheets, said adhesive being applied to secure less than the entire surrounding margin of each respective web to the web-receiving area of the corresponding base sheet to thereby present an opening between a portion of said web and the corresponding base sheet and for thereby defining a pocket between each respective web and the web-receiving area of its corresponding base sheet.

2. A continuously produced business form as set forth in claim 1, said base sheet being a sheet of paper.

3. A continuously produced business form as set forth in claim 2, including a cover sheet, said cover sheet being joined to said base sheet with said web positioned intermediate said base sheet and said cover sheet.

4. A continuously produced business form as set forth in claim 3, said cover sheet having a carbonless back coating and said web having a carbonless front coating facing in opposition to said carbonless back coating.

5. A continuously produced business form as set forth in claim 1, including a strip having an adhesive backing removably adhered to one of said base sheet and said web.

6. A continuously produced business form as set forth in claim 5, including a line of release coating applied to said base sheet for receiving said strip thereon.

7. A continuously produced business form as set forth in claim 6, said base sheet including a flap exterior to said web-receiving area and adjacent said opening for folding over said web to enclose said pocket.

8. A continuously produced business form as set forth in claim 7, including a line of weakness defined in said base sheet adjacent said opening to define a fold line for said flap, said fold line being contiguous with a portion of said circumscribing edge.

9. A continuously produced business form as set forth in claim 1, including longitudinally extending tractor feed tabs connected to said base sheet along opposed longitudinally extending side edges of said base sheet.

10. A continuously produced business form as set forth in claim 1, wherein said circumscribing edge includes transversely extending lines of weakening defining adjacent base sheets.

11. A continuously produced business form as set forth in claim 10, wherein said transversely extending lines are provided by lines of perforations.

* * * * *